United States Patent [19]

Scruggs

[11] Patent Number: 4,743,513

[45] Date of Patent: May 10, 1988

[54] WEAR-RESISTANT AMORPHOUS MATERIALS AND ARTICLES, AND PROCESS FOR PREPARATION THEREOF

[75] Inventor: David M. Scruggs, San Juan Capistrano, Calif.

[73] Assignee: Dresser Industries, Inc., Dallas, Tex.

[21] Appl. No.: 503,174

[22] Filed: Jun. 10, 1983

[51] Int. Cl.[4] ..... B32B 15/18; B32B 15/00

[52] U.S. Cl. ..... 428/668; 148/403; 420/121; 420/125; 420/127; 420/435; 420/441; 420/580; 420/581

[58] Field of Search ..... 428/611, 615, 668, 680, 428/681, 656, 636, 610; 148/403, 39; 420/435, 441, 459, 580, 581, 584, 585, 586; 75/123 B, 123 J, 123 M

[56] References Cited

U.S. PATENT DOCUMENTS

| | | | |
|---|---|---|---|
| 2,842,439 | 7/1958 | Ebeling | 420/586 |
| 3,871,836 | 3/1975 | Polk et al. | 420/581 |
| 4,056,411 | 11/1977 | Chen et al. | 148/403 |
| 4,059,441 | 11/1977 | Ray et al. | 148/403 |
| 4,067,732 | 1/1978 | Ray | 75/123 B |
| 4,079,430 | 3/1978 | Fujishima et al. | 360/126 |
| 4,101,389 | 7/1978 | Uedaira | 204/44 |
| 4,116,682 | 9/1978 | Polk et al. | 75/123 J |
| 4,122,240 | 10/1978 | Banas et al. | 148/39 |
| 4,133,679 | 1/1979 | Ray | 75/123 B |
| 4,133,681 | 1/1979 | Ray | 148/403 |
| 4,133,682 | 1/1979 | Ray | 148/403 |
| 4,137,075 | 1/1979 | Ray et al. | 420/435 |
| 4,152,144 | 5/1979 | Hasegawa et al. | 75/123 B |
| 4,190,438 | 2/1980 | Aso et al. | 75/123 B |
| 4,210,443 | 7/1980 | Ray | 75/123 B |
| 4,221,592 | 9/1980 | Ray | 75/123 B |
| 4,264,358 | 4/1981 | Johnson et al. | 148/403 |
| 4,297,135 | 10/1981 | Giessen et al. | 75/123 B |
| 4,318,738 | 3/1982 | Masumoto et al. | 148/403 |
| 4,337,886 | 7/1982 | King et al. | 148/39 |
| 4,390,498 | 6/1983 | Luyckx | 420/420 |
| 4,437,912 | 3/1984 | Sakakima et al. | 148/403 |
| 4,464,208 | 8/1984 | Tateishi | 148/403 |

FOREIGN PATENT DOCUMENTS

| | | | |
|---|---|---|---|
| 0051919 | 4/1979 | Japan | 148/403 |
| 2106145 | 4/1983 | United Kingdom . | |

OTHER PUBLICATIONS

Polk et al., "The Preparation and Thermal and Mechanical Properties of New Titanium Rich Glasses", *Acta Metallurgica*, vol. 26, pp. 1097–1103, Pergamon Press, 1978.

*Metallic Glasses*, American Society for Metals, pp. 9–12, 1978.

MCIC Report/Oct. 1981 (MCIC-81-45) Metals and Ceramics Information Center—"Review of Rapid Solidification Technology" pp. 57–71 by R. S. Carbonara et al.

National Materials Advisor Board #358 ADA086000/80 6 23 11 Commission on Sociotechnical Systems—Amorphous and Metastable Microcrystalline Rapidly Solidified Alloys: Status and Potential (1980 pp. 91–93).

The American Physical Society—Physical Review B, vol. 20, No. 4, Aug. 15, 1979, Structure and Properties of Transition-Metal—Metalloid Glasses Based on Refractory Metals by W. Johnson & A. Williams of Keck Labs of Eng'g Metals. Pas. Calif. (pp. 1640–1655).

12/20/82—B. C. Geissen, Materials Science Division, Institute of Chemical Analysis, Northwestern University, Characterization of Mechanical, Thermal and Wear Properties of Titanium Rich Metallic Glasses.

A. Inoue et al.—Research Institute for Iron, Steel and Other Metals, Tokohu University, Japan, Mechanical Properties of (Fe, Co, Ni) —M—B (M—Ti, Zr, Hf, V, Nb, Ta and Mo) Amorphous Alloys with Low Boron Concentration.

*Primary Examiner*—L. Dewayne Rutledge
*Assistant Examiner*—Robert L. McDowell
*Attorney, Agent, or Firm*—Gregory O. Garmong; William R. Peoples

[57] ABSTRACT

Wear-resistant materials and articles, wherein an amorphous material having a hardness of greater than about 1600 VHN is utilized to protect wear-susceptible portions of substrates or is itself made into a wear-resistant article. Amorphous materials having hardnesses greater than about 1600 VHN are found to have surprisingly great wear resistance and can be used to prepare wear-resistant articles. Particularly satisfactory results have been obtained with metal-metalloid systems such as W—Ru—B, Re—Mo—B, Mo—Ru—B, and Co—Nb—B materials.

1 Claim, 1 Drawing Sheet

WEAR-RESISTANT AMORPHOUS MATERIALS AND ARTICLES, AND PROCESS FOR PREPARATION THEREOF

BACKGROUND OF THE INVENTION

This invention relates generally to wear-resistant materials and articles, and more particularly to amorphous materials and articles having excellent wear resistance.

Wear is a problem of enormous significance, since even by conservative estimates billions of dollars are lost each year as a result of wear. The costs of wear arise directly through the need to replace worn articles such as machine components, and also indirectly through reduced machinery efficiency, loss of critical tolerances in machinery, breakdowns caused by wear and down time necessitated by the need to inspect and replace worn components. Thus, the economic loss due to wear is not simply proportional to the amount of material worn away.

Wear may occur by a variety of mechanisms, and several different schemes of classifying wear processes have been proposed. According to one such classification scheme, in a particular situation wear may occur by abrasion, adhesion, erosion, fretting, or chemical mechanisms, or by combinations of two or more such mechanisms. As a result of the several mechanisms and many types of materials subjected to wear, no generally satisfactory method for predicting the wear resistance of materials or articles has been found. In some environments and applications, hard materials such as ceramics have been found to be wear-resistant, while in other environments and applications soft materials such as rubber are favored.

Wear of articles is generally controlled by proper design, by selection of wear-resistant materials and by protection of materials in use. In the design approach, wear is minimized or avoided by minimizing the exposure of susceptible materials to a wear-inducing environment. Materials are protected in use by various means such as lubrication of wearing components. In the material selection approach, wear-resistant materials are developed, tested and selected for use in wear-inducing environments such as earth moving or drilling, where the exposure cannot be avoided by proper design.

Regardless of the mechanism of wear, wear is generally a phenomenon occurring at or near a surface rather than in the interior of the material. A wide variety of techniques have been developed for improving the wear resistance of surfaces, including heat treatments, surface composition or hardness treatments, and the use of wear-resistant coatings or hard facings. Together with the development of more highly wear-resistant bulk materials, these techniques have resulted in improved wear resistance of articles such as those used in machine components. However, the most wear-resistant materials have serious shortcomings in specific applications. Rubber has a low strength and cannot be used at high temperatures. Hard-facing alloys typically are brittle or have little ductility, limiting their means of application and leading to cracking and spalling of the coating in use. Popular bulk wear-resistant alloys such as tungsten carbide-cobalt (WC-Co) powder materials lack tensile strength and ductility, are often not readily fabricated as coatings or hard facings, and are susceptible to flaking and spalling during use. Materials are often required for use in corrosive environments, and many common wear-resistant materials lack the combination of corrosion and wear resistance.

Thus, there continues to be a need for improved materials for use in resisting or protecting against wear. In particular, there exists a present need for materials having high wear resistance, good tensile and compressive strength, ductility, corrosion resistance and fabricability. The present invention fulfills this need, and further provides related advantages.

SUMMARY OF THE INVENTION

The present invention relates to a process for preparing wear-resistant materials and articles, the materials and articles themselves, and specific compositions of amorphous materials having high wear resistance. The amorphous materials are used to protect articles that are subject to wear, or are fabricated directly into wear-resistant articles. The amorphous materials of the invention have wear resistance many times greater than those of low-carbon steel and hardened steels. Additionally, their wear resistance can be greater even than that of typical bulk wear-resistant cermets such as WC-3%Co, while exhibiting good strength, modest ductility, corrosion resistance and fabricability. With this invention, thin, highly wear-resistant surface layers may be applied to articles used in a wear-inducing environment to protect the portions most susceptible to wear.

In accordance with the invention, amorphous materials having a Vickers Hardness Number (hereinafter sometimes VHN) of greater than about 1600 have surprisingly improved wear-resistance properties as compared with those of amorphous and crystalline materials having a hardness of less than about 1600 VHN. The wear-resistant amorphous materials are fabricated into wear-resistant articles, or are prepared as thin layers for protecting the surfaces of substrates. The amorphous materials of the present invention are readily fabricated as thin sheets for use in protecting the surfaces of substrate articles, as for example in the bonding of a previously formed amorphous material having a hardness greater than about 1600 VHN to a tool to protect its surface from wear. Alternatively, a wear-resistant amorphous material may be fabricated as an integral layer on the surface of such a substrate article, again resulting in improved wear-resistance. The substrate may be a non-amorphous material having substantially the same chemical composition as the piece of amorphous material positioned to protect it.

It will be appreciated from the foregoing that the present invention represents a significant advance in the fabrication of wear-resistant articles. Using the amorphous materials of the invention, articles having significantly increased resistance to wear may be fabricated. The articles may be prepared in their entirety from the amorphous material, or, more economically, the amorphous material may be applied to a substrate itself formed in the shape of a useful article. With this latter approach, the amorphous material may be applied selectively only to those portions of the substrate requiring enhanced wear resistance. The specific amorphous material compositions presently preferred as wear-resistant amorphous materials having a hardness greater than about 1600 VHN include W-Ru-B, Re-Mo-B, Mo-Ru-B, and Co-Nb-B.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate aspects of the testing of the amorphous materials of the invention and the results of the testing. In such drawings.

DETAILED DESCRIPTION OF THE PREFERRED EMBODIMENT

Metals ordinarily solidify from the molten state as crystals having a periodically repeating crystalline structure. When properly processed, however, normally crystalline materials may be prepared in an amorphous state exhibiting little or no structural periodicity. As an example, amorphous materials such as metallic alloys are typically produced by rapid solification from the liquid state at cooling rates of about $10^5$ degrees Centrigrade per second, or greater. To achieve the high cooling rates, the amorphous materials are solidified as thin sheets or strips having a thickness of less than about 0.07 mm by depositing a liquid alloy on a cooled substrate as a thin layer so that heat is extracted very rapidly and high cooling rates are achieved. A variety of techniques for producing amorphous materials are well known in the art.

The amorphous materials have no grains or grain boundaries, and are consequently resistant to attack by corrosion. Amorphous materials may be converted back to the crystalline state by introducing sufficient energy to induce a transformation to a periodic structure, as by heating the amorphous material to a sufficiently high temperature. Since many of the beneficial properties of the amorphous state are lost upon crystallization, a high crystallization temperature, indicating resistance to crystallization, is desirable.

In accordance with the present invention, an amorphous material having a hardness greater than about 1600 VHN provides improved wear resistance for articles susceptible to wear. The amorphous material may be fabricated and then applied to the wear-susceptible portions of a substrate, or the amorphous material may be fabricated directly on the surface of the substrate as a wear-resistant surface layer. Alternatively, the amorphous material may itself be fabricated into a useable, wear-resistant article. Particularly satisfactory results have been obtained with metal-metalloid alloys such as W-Ru-B, Re-Mo-B, Mo-Ru-B, and Co-Nb-B alloys, which have excellent ductility in comparison with conventional wear-resistant materials such as carbides and hard metals, and high crystallization temperatures as well as high hardness.

Figure 1:
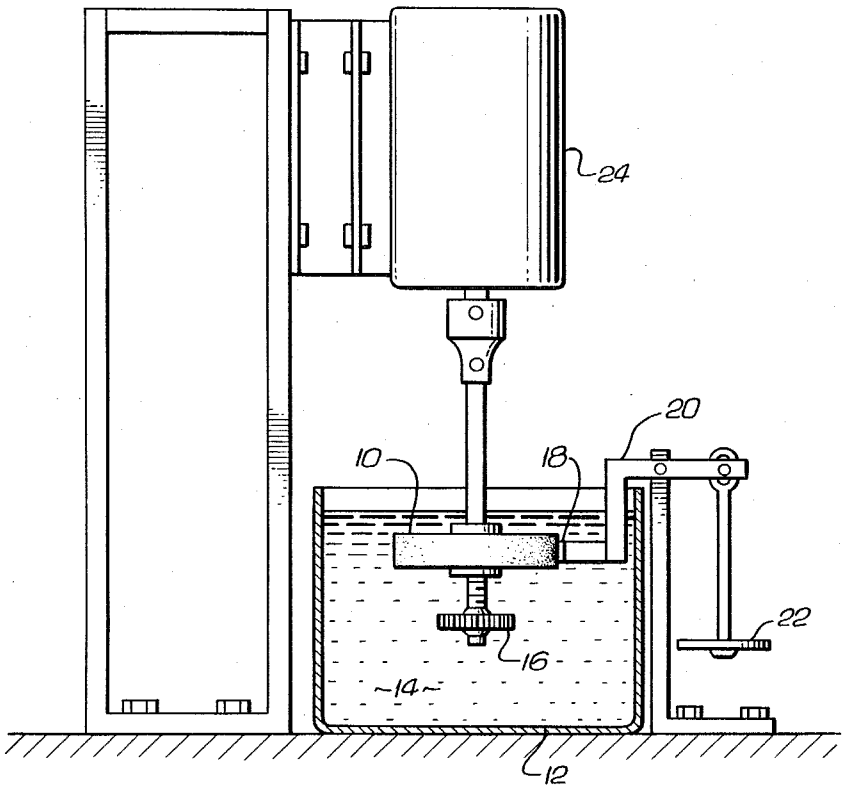
FIG. 1 is an elevational side view of a slurry wear tester used to evaluate the wear resistance of materials.

As indicated previously, wear may occur by abrasion, adhesion, erosion, fretting, or chemical mechanisms, or by a combination of two or more such mechanisms. No single test provides a measurement of all of the various mechanisms of wear, and to evaluate the materials of the present invention, a conventional type of slurry wear tester was constructed. The slurry wear tester illustrated in FIG. 1 primarily measures abrasive wear by causing abrasive particles to be dragged across a surface of a sample being tested. A three-inch diameter flexane-60 urethane rubber disc 10 rotates horizontally in a container 12 holding a slurry 14. A paddle wheel 16 continually stirs the slurry 14. A specimen 18 of about $\frac{3}{8}$ inch diameter or less of known weight is pressed against the disc 10 by a linkage 20 loaded with a 3 pound dead weight 22. The disc 10 is rotated over the specimen 18, typically 70 revolutions per minute by a motor 24 for fifteen or thirty minutes. the specimen 18 is then weighed and the weight loss during the test is calculated. Weights are carefully measured in all cases, using a balance accurate to 0.00001 gram. A relative wear resistance WR is then calculated as:

$$WR = Ws/Wr \times dr/ds$$

where:

Ws is the weight loss for a standard 301 stainless steel sample tested under the same conditions;

Wr is the weight loss for the material under evaluation;

ds is the density of 301 stainless steel; and dr is the density of the material under evaluation.

In the results reported herein, the slurry 14 is prepared as a mixture of 200 parts of 200 mesh quartz sand with 94 parts water, the mixture being stabilized by an addition of 0.25 parts xanthan gum. The slurry 14 and the rubber disc 10 are changed at the end of each day of testing, and no more than four thirty-minute tests are accomplished during each day. A 301 stainless steel standard is measured at the beginning or end of each day of testing, and results of this test provide a basis for ensuring reproducibility of results from day to day.

Figure 2:
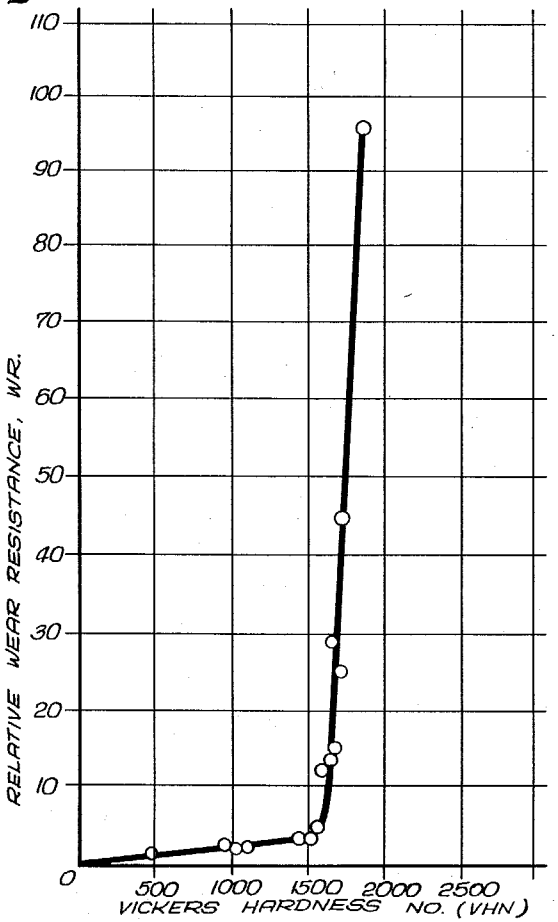
FIG. 2 is a graph comparing the relative wear resistance of some amorphous materials of the invention as compared with the wear resistance of other amorphous materials, all measured in the wear tester illustrated in FIG. 1.

Results of the wear testing are presented in FIG. 2 as a plot of relative wear resistance as a function of sample hardness. The relative wear resistance WR, calculated as described above, is plotted relative to that of 301 stainless steel which has been arbitrarily assigned a wear resistance WR of 1.0 as measured in transverse section. The Vickers Hardness Number (VHN) of each sample is determined by a standard Vickers hardness test, using a penetrator load of 100 grams. (For a more complete discussion of the Vickers hardness test, see "The Making, Shaping and Treating of Steel," Ninth Ed., 1971 (Published by United States Steel Co.), at p. 1236) In FIG. 2 are plotted the results of the examples reported hereinbelow illustrating embodiments of the invention, as well as the results of testing amorphous materials having hardnesses less than those prepared in accordance with the present invention.

As may be seen by inspecting FIG. 2, the wear resistance of amorphous materials may be divided into two groups. The wear resistance of the materials having hardnesses less than about 1600 VHN increases generally linearly to about 4–5 times the wear resistance of the stainless steel standard. For amorphous materials having hardnesses above about 1600 VHN, the wear resistance is at least several times greater than that of the most wear-resistant amorphous material of the first group.

FIG. 2 shows that the division between the less wear-resistant and more wear-resistant groups of amorphous materials does not occur at a single value, but instead occurs over a range of values at about 1500–1600 VHN. Hardnesses of about 1600 VHN and greater produce suprisingly great wear resistances. Hardnesses below about 1500 VHN produce wear resistances of more conventional values, which are more easily predictable.

Further, the results of FIG. 2 are for only a single specific type of wear testing. It is therefore understood that the use herein of the term "about 1600 VHN" as the division between the two groups represents a range in the threshold level of the improved wear resistance and is subject to some variation in materials and testing procedures, perhaps as much as 100 points of VHN or more.

The following table sets forth examples of the relative wear resistance of several amorphous materials, which are also plotted in the graph of FIG. 2. However, these examples are not intended to limit the invention, but instead are presented as illustrative of results within and not within the scope of the invention:

| Composition | VHN | WR |
|---|---|---|
| Pd bal, 34.3 Cu, 8.4 P | 500 | 1.1 |
| Fe bal, 3.64 B, 2.36 Si | 925 | 2.3 |
| Fe bal, 12.24 Mo, 3.45 B, 1.12 Si, 1.24 P | 980 | 2.3 |
| Nb bal, 40 Ni, 2.3 B | 1100 | 2.4 |
| Mo bal, 40 Ru, 2.4 B | 1400 | 3.6 |
| W bal, 12.7 Fe, 15.4 Ru, 2.1 B | 1450 | 4.0 |
| W bal, 25 Ru, 23 Fe, 4 Ni, 3.3 B | 1580 | 4.6 |
| W bal, 44 Ru, 2.5 B | 1600 | 13 |
| Co bal, 38.4 Nb, 5.0 B | 1650 | 14 |
| Mo bal, 40 Ru, 3.35 B | 1660 | 15.5 |
| Re bal, 33.4 Mo, 1.65 B | 1700 | 25 |
| Mo bal, 40 Ru, 3.0 B | 1650 | 29.5 |
| W bal, 34.8 Ru, 1.86 B | 1700 | 46 |
| W bal, 26.5 Ru, 1.76 B | 1800 | 96 |

(All compositions in weight percent, as are all compositions set forth herein. "bal" indicates that the balance of the material is the specified element, so that the percentages total 100.)

To achieve the high wear resistances in accordance with this invention, amorphous materials must have hardnesses greater than about 1600 VHN. Certain classes of amorphous materials have been found to have such high hardnesses, including metal-metalloid amorphous materials. A metal-metalloid amorphous material is formed by rapidly cooling a melt of the proper proportions of one or more metals and one or more metalloids such as B, C, P, or Si. One example of a suitable metal-metalloid material is compositions within the range W bal, 26–35 Ru, 1.8–3.4 B. Amorphous materials in this composition range have hardnesses near or above about 1600 VHN, have good bend ductilities, and are resistant to crystallization. Molybdenum may be substituted in whole or in part for the tungsten at higher levels of metalloid and rhenium may be substituted in whole or in part for ruthenium.

The cost of the amorphous material may be reduced by substituting in less costly ingredients, while retaining the necessary hardness of above about 1600 VHN and the ability to achieve the amorphous state upon solidification. For example, iron may be substituted for some of the ruthenium in the W-Ru-B material. Further, it is believed that other metalloids such as P, C, or Si could be substituted in part for the B in the W-Ru-B or W-Ru-Fe-B alloys.

Another metal-metalloid material having the necessary high hardness is Co bal, 38 Nb, 5 B. As with the case of W-Ru-B, it is believed that other elements may be substituted for the Nb, Co and B in whole or in part, while retaining the necessary hardness greater than about 1600 VHN. Niobium is an early transition metal, and it is believed that other early transition metals such as Ti, V and Zr may be substituted in whole or in part for the Nb in the Nb-Co-B alloy. Similarly, Co is a late transition metal, and it is believed that other late transition metals such as Fe or Ni may be substituted in whole or in part for the Co. And, it is believed that other metalloids such as P, Si or C may be substituted in part for the B. Further, as with the addition of Fe to the W-Ru-B material, it is believed that minor amounts of other elements may be substituted for the Nb or Co, while retaining the amorphous character and hardness greater than about 1600 VHN.

Depending upon the fabrication technique, a particular material may be entirely amorphous or only partly amorphous. It is understood that both fully and partially amorphous materials are within the scope of the present invention, as long as the hardness of the amorphous portion exceeds about 1600 VHN.

In developing other wear-resistant amorphous materials in accordance with the present invention, various combinations of constituents may be utilized. However, whatever the precise composition, such wear-resistant materials should be wholly or partially amorphous, and the amorphous portion must have a hardness of greater than about 1600 VHN.

Amorphous materials having hardness greater than about 1600 VHN may be used in a variety of ways to reduce wear. The amorphous material is sometimes used without attachment to a substrate as a wear resistant article.

More commonly, the amorphous material is attached to a substrate to impart wear resistance to the substrate. As used herein, a "substrate" is an article having a useful function, but whose usefulness is diminished during its life by wear. The amorphous material is applied to the substrate over the portions susceptible to wear, so that the amorphous material protects the substrate from wear due to its greater wear resistance. In this approach, the substrate is formed essentially to its useful shape. The amorphous material is fabricated as a separate piece and then applied to the substrate in the wear-susceptible area, by a joining means such as bonding, adhesive, fasteners, or other suitable means. In an alternative application approach, an overlay of the amorphous material composition is deposited on, or joined to, the surface of the substrate in the amorphous state, or deposited in the non-amorphous state and then transformed to the amorphous state in place.

In the latter approach, a non-amorphous layer having the proper composition is deposited on the surface, and then transformed to the amorphous state. Alternatively, an article could be formed from a material in its non-amorphous state, and the surface layer transformed to the amorphous state. Such transformations may be accomplished, for example, by momentarily melting the surface layer with a high-energy source such as a laser, and then allowing the melted portion to solidify on the substrate. Other high-energy sources such as electron beams, magnetic fields, or high-frequency induction may also be satisfactory. The substrate acts as a heat sink to extract the heat from the deposit rapidly so as to achieve the necessary high cooling rate for attainment of the amorphous material. In such a process, minor amounts of subtrate material may be melted into the amorphous layer but such further additions to the amorphous material are acceptable if the material remains wholly or partially amorphous and has hardness greater than about 1600 VHN.

In yet another approach, a piece of wear-resistant amorphous material may be used to protect a substrate or article without being in physical contact with the substrate or article. For example, the amorphous material may be suspended remotely from the substrate to deflect a wear-inducing stream so that the stream does not impact upon the substrate.

It will now be appreciated that this invention provides a highly wear-resistant material having significant advantages in reducing damage due to wear. Amorphous materials having hardnesses greater than about 1600 VHN have wear resistance significantly and unexpectedly greater than that of other amorphous materials and of commonly used non-amorphous materials. Further, such amorphous materials are fabricable into surface-protective materials with good strength, modest ductility, corrosion resistance, and resistance to crystallization.

Although a particular embodiment of the invention is described in detail for purposes of illustration, various embodiments may be made without departing from the spirit and the scope of the invention. Accordingly, the invention is not to be limited except as by the appended claims.

I claim:

1. An article of manufacture having a structure which is highly wear resistant, comprising:

a substrate; and a piece of material positioned to protect said substrate from wear, said piece of material being at least partly amorphous, the amorphous portion having a hardness greater than about 1600 VHN, whereby the structure of said article is highly wear resistant, and wherein the amorphous material consists essentially of the chemical composition $X_rY_sB_t$, where X is at least one element selected from the group consisting of titanium, vanadium and niobium, Y is at least one element selected from the group consisting of cobalt, nickel, and iron, and r, s, and t are weight percentages wherein r ranges from about 32 to about 48, s ranges from about 44 to about 63, t ranges from about 5 to about 8, and the sum of r, s, and t is substantially 100.

* * * * *